US006814552B2

(12) United States Patent
Wu

(10) Patent No.: US 6,814,552 B2
(45) Date of Patent: Nov. 9, 2004

(54) PUMP CAPABLE OF RELEASING EXCESSIVE AIR

(75) Inventor: Scott Wu, Taichung Hsien (TW)

(73) Assignees: Specialized Bicycle Components, Inc., Morgan Hill, CA (US); Co-Luck Enterprise Co., Ltd., Taichung Hsien (TW)

( * ) Notice: Subject to any disclaimer, the term of this patent is extended or adjusted under 35 U.S.C. 154(b) by 8 days.

(21) Appl. No.: 10/335,741

(22) Filed: Jan. 2, 2003

(65) Prior Publication Data

US 2004/0086404 A1 May 6, 2004

(30) Foreign Application Priority Data

Oct. 31, 2002 (TW) ..... 91217618 U

(51) Int. Cl.[7] ..... F16K 15/20; F04B 23/00
(52) U.S. Cl. ..... 417/440; 137/228
(58) Field of Search ..... 417/440, 315, 417/239, 536, 545, 547, 468; 137/226, 224, 493.9, 228

(56) References Cited

U.S. PATENT DOCUMENTS

| | | | | | |
|---|---|---|---|---|---|
| 4,334,839 | A | * | 6/1982 | Flagg | 417/536 |
| D323,876 | S | * | 2/1992 | Furusawa | D23/231 |
| 5,702,239 | A | * | 12/1997 | Yang | 417/512 |
| 5,964,577 | A | * | 10/1999 | Chuang | 417/63 |
| 6,371,741 | B1 | * | 4/2002 | Wu | 417/446 |
| 6,422,832 | B1 | * | 7/2002 | Wang | 417/315 |

* cited by examiner

*Primary Examiner*—Charles G. Freay
(74) *Attorney, Agent, or Firm*—Alan D. Kamrath; Nikolai & Mersereau, P.A.

(57) ABSTRACT

A pump capable of releasing excessive air is shown to include a hollow base, a cylinder installed on and communicated with the hollow base, a piston movably received in the cylinder, a piston tube including a lower end connected with the piston and an upper end located beyond the cylinder, a tube including a lower end communicated with the hollow base and an upper end inserted into the piston tube through a channel defined in the piston, a release valve mounted on the upper end of the piston tube and a handle mounted on the upper end of the piston tube. The valve is installed on the handle so that it can be touched conveniently and operated easily by a user who is using the pump.

6 Claims, 5 Drawing Sheets

PUMP CAPABLE OF RELEASING EXCESSIVE AIR

BACKGROUND OF INVENTION

1. Field of Invention

The present invention relates to a pump that is capable of releasing excessive air.

2. Related Prior Art

Taiwanese Patent Publication No. 446070 teaches an upright pump including internal and external cylinders. This conventional pump includes a base 10, an internal cylinder 20 mounted on the base 10, a piston 43 movably received in the internal cylinder 20, a rod 41 connected with the piston 43, an external cylinder 50 mounted on the internal cylinder 20, a pressure gauge assembly 70 mounted on the external cylinder 50 and a nozzle 90 in communication with the pressure gauge assembly 70 through a pipe 80. The internal cylinder 20 defines a space 22 and an aperture 25 at a lower end in communication with the space 22. A space 52 is confined between the internal cylinder 20 and the external cylinder 50. The space 22 is in communication with the space 52 through the aperture 25. The external cylinder 50 defines an aperture 53 near an upper end. The pressure gauge assembly 70 is located at the upper end of the external cylinder 50. A space defined in the pressure gauge assembly 70 is in communication with the spare 52 through the aperture 53. In pumping, pressurized air flows from the space 22 to the space 52 from which the pressurized air flows to the space defined in the pressure gauge assembly 70 through the aperture 53. Although this conventional pump is equipped with the pressure gauge assembly 70, a user may still over pump, for example, a tire with it. When this happens, it is better for the user to release air from the tire. Such releasing excessive air from the tire is not possible unless the nozzle 90 is removed from a valve of the tire. Such removal of the nozzle 90 from the valve of the tire is however inconvenient. What is worse, the user does not know if he or she releases too much air from the tire unless he or she engages the nozzle 90 with the valve of the tire again. This renders precise pumping more difficult.

The present invention is therefore intended to obviate or at least alleviate the problems encountered in prior art.

SUMMARY OF INVENTION

It is the primary objective of the present invention to provide a pump that is capable of releasing excessive air.

According to the present invention, a pump capable of releasing excessive air is shown to include a hollow base, a cylinder installed on and communicated with the hollow base, a piston movably received in the cylinder, a piston tube including a lower end connected with the piston and an upper end located beyond the cylinder, a tube including a lower end communicated with the hollow base and an upper end inserted into the piston tube through a channel defined in the piston, a release valve mounted on the upper end of the piston tube and a handle mounted on the upper end of the piston tube. The valve is installed on the handle so that it can be touched conveniently and operated easily by a user who is using the pump.

Other objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
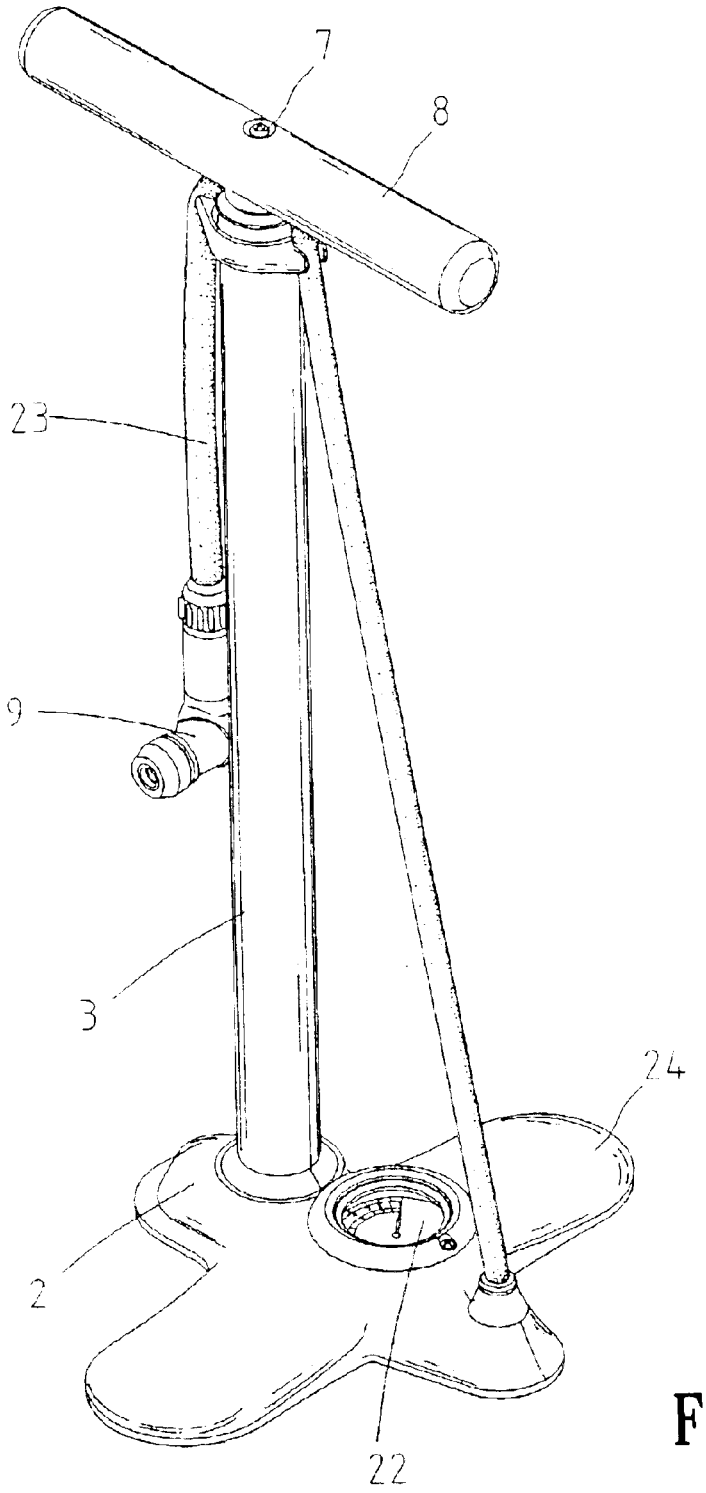
FIG. 1 is a perspective view of a pump that is capable of releasing excessive air according to the present invention.
Figure 2:
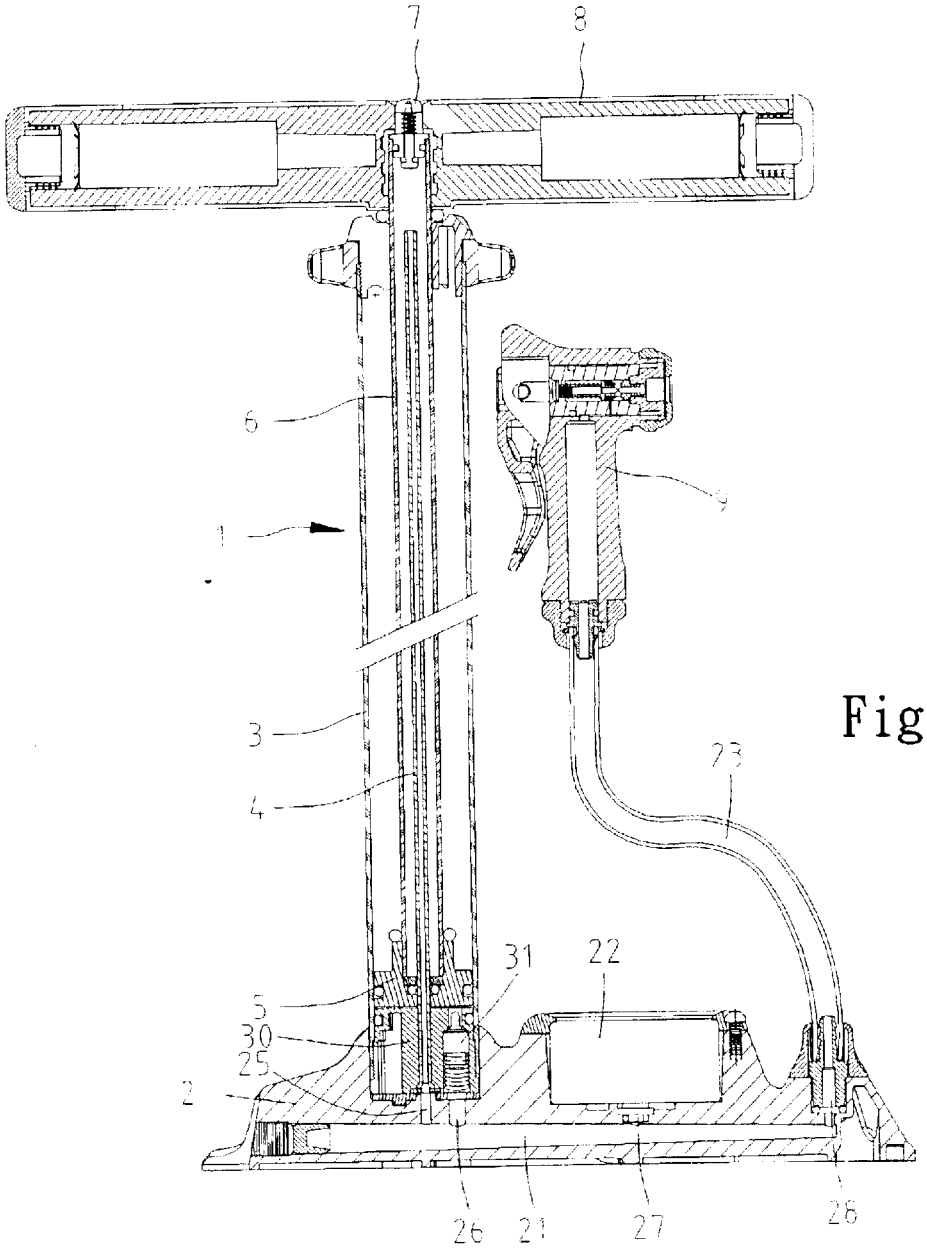
FIG. 2 is a cross-sectional view of the pump shown in FIG. 1.

Referring to FIGS. 1 and 2, according to the preferred embodiment of the present invention, a pump 1 capable of releasing excessive air is shown to include a hollow base 2, a cylinder 3 installed on and communicated with the hollow base 2, a piston 5 movably received in the cylinder 3, a piston tube 6 including a lower end connected with the piston 5 and an upper end located beyond the cylinder 3, a tube 4 including a lower end communicated with the hollow base 2 and an upper end inserted into the piston tube 6 through a channel (not numbered) defined in the piston 5, a release valve 7 mounted on the upper end of the piston tube 6 and a handle 8 mounted on the upper end of the piston tube 6. The valve 7 is installed on the handle 8 so that it can be touched conveniently and operated easily by a user who is using the pump 1.

The base 2 includes two treads 24 on which the user can set his or her feet in order to hold the pump 1 still. The base 2 defines a trunk channel 21 and branch channels 25~28 each communicated with the trunk channel 21.

The cylinder 3 is installed on the base 2. The space defined in the cylinder 3 is communicated with the channels 25 and 26. A plug 30 is fit in the lower end of the cylinder 3. The plug 30 defines a first channel (not numbered) communicated with the branch channel 26 and a second channel (not numbered) communicated with the branch channel 25. A check valve 31 is installed in the first channel defined in the plug 30.

A pressure gauge 22 is installed on the base 2 and communicated with the branch channel 27.

A flexible pipe 23 includes an end communicated with the branch channel 28 and an opposite end communicated with a nozzle 9 for engagement with a valve of an article to be inflated.

Figure 3:
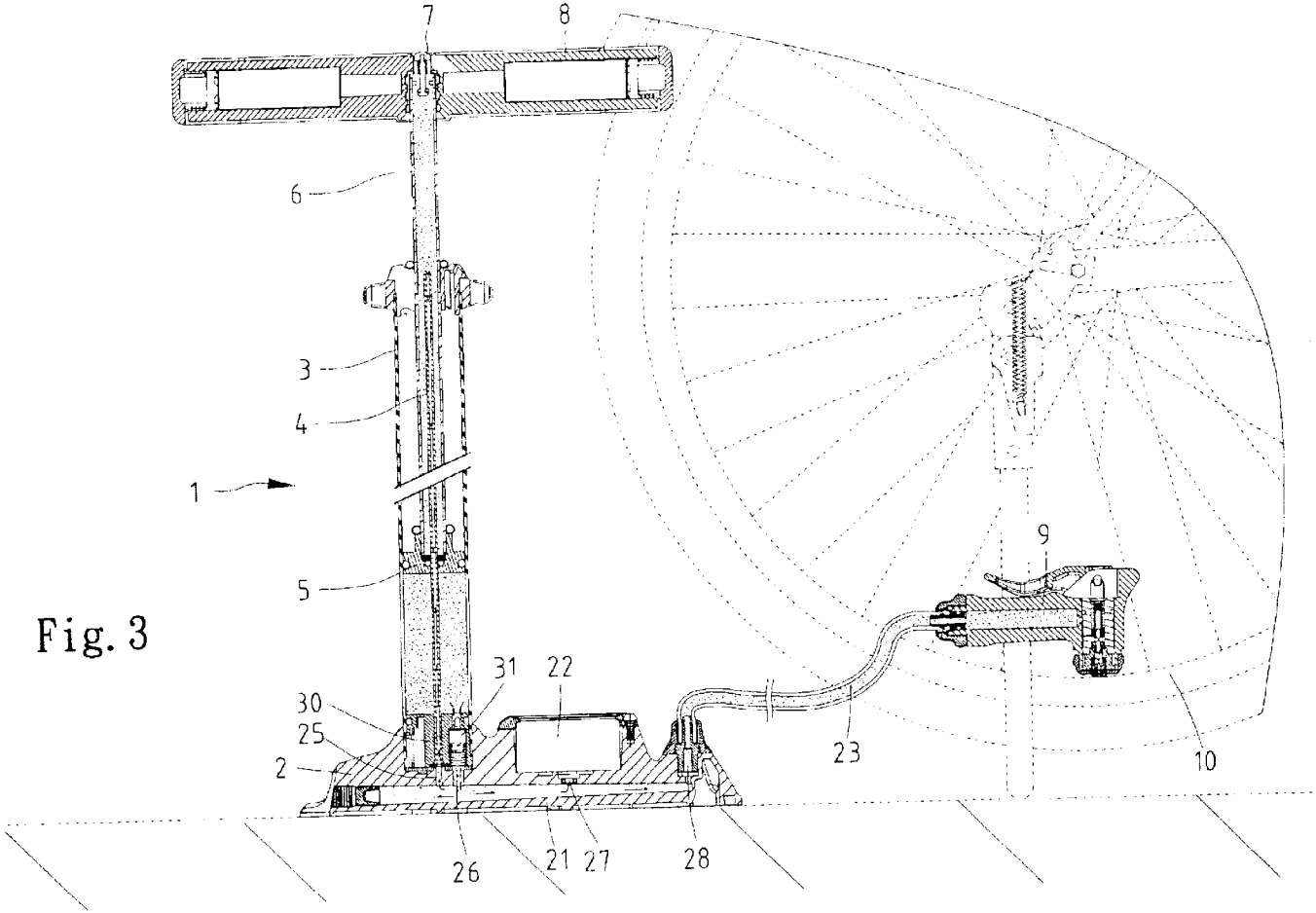
FIG. 3 shows in a reduced scale the pump shown in FIG. 2 pumping air into a tire.

Referring to FIG. 3, a user (not shown) can operate the handle 8 in order to push down the piston tube 6 and the piston 5. Thus, pressurized air is pumped from the cylinder 31 to the trunk channel 21 through the check valve 3. A major portion of the pressurized air is transmitted from the trunk channel 21 to the nozzle 9 through the flexible pipe 23. The nozzle 9 is engaged with a valve of a tire 10 so that the major portion of the pressurized air is transmitted into the tire 10. A minor portion of the pressurized air is transmitted from the trunk channel 21 into the piston tube 6 through the tube 4.

The user can monitor the pressure in the tire 10 from the pressure gauge 22 since the tire 10 is communicated with the pressure gauge 22 through the nozzle 9, the flexible pipe 23 and the trunk channel 21.

Figure 4:
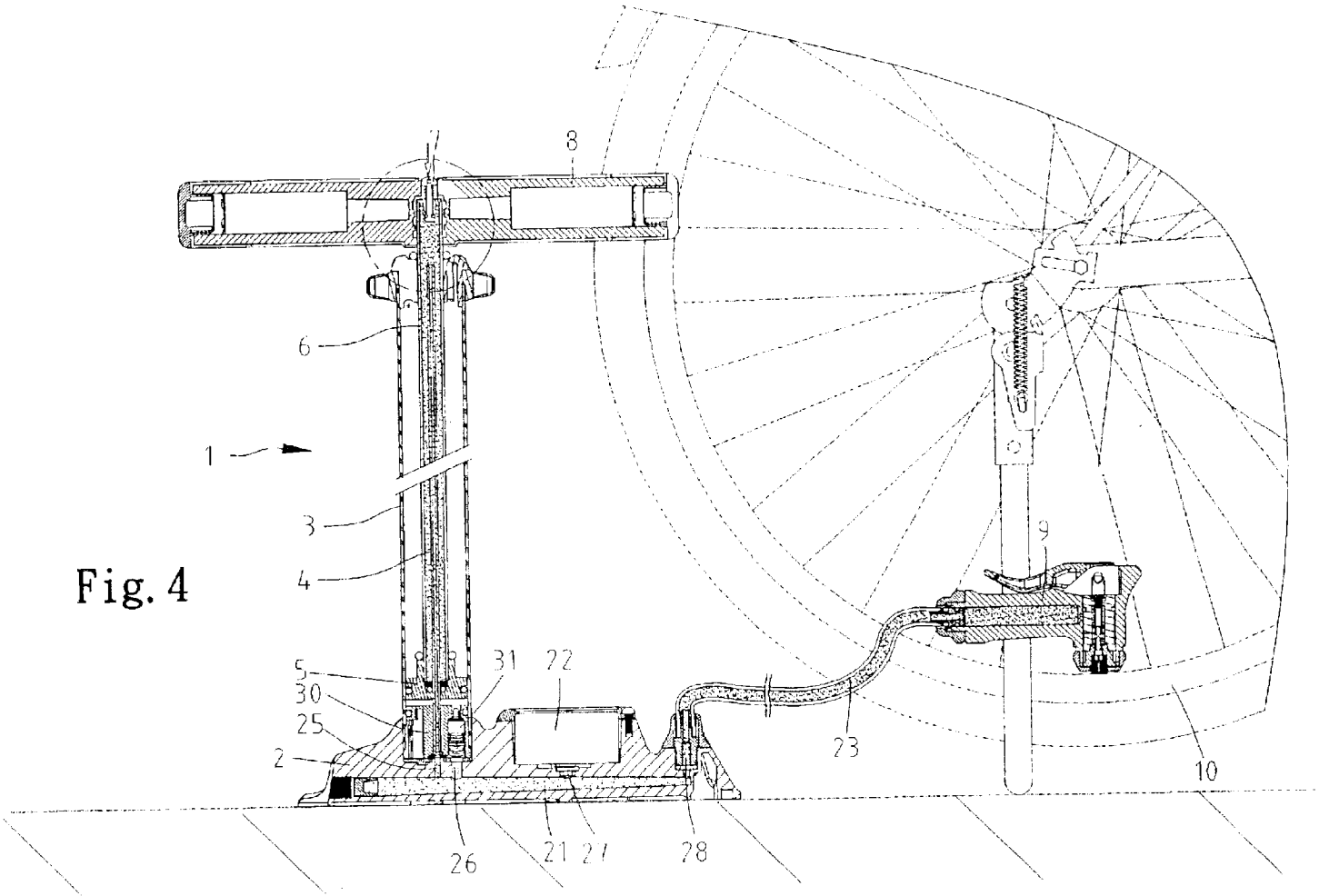
FIG. 4 is similar to FIG. 3 but showing the pump releasing air from the tire.
Figure 5:
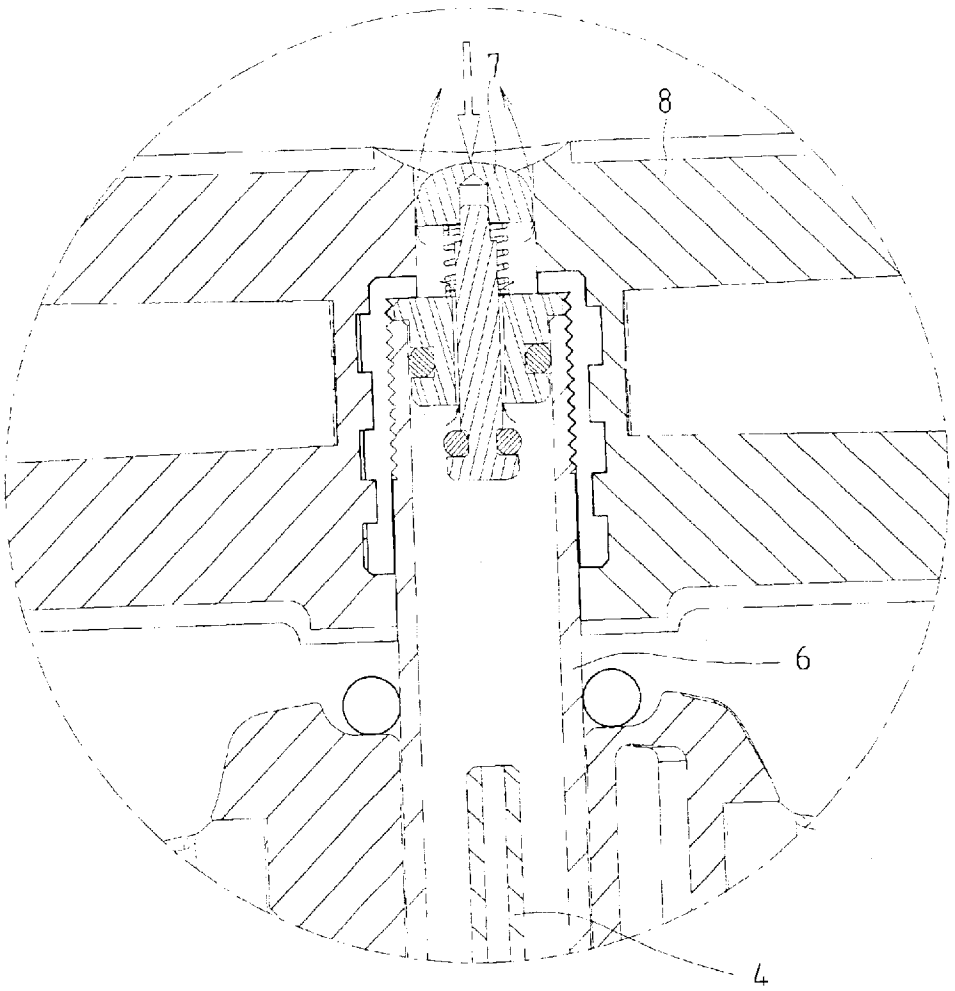
FIG. 5 shows in an enlarged scale the pump shown in FIG. 4.

If the pressure is inadequately high, the user can operate the release valve 7 in order to release excessive pressurized air from the tire 10 as shown in FIGS. 4 and 5.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the claims.

What is claimed is:

1. A pump capable of releasing excessive pressure including:

a hollow base in communication with an article to be inflated;

a cylinder installed on and communicated with the hollow base;

a check valve installed between the hollow base and the cylinder;

a piston being movably received in the cylinder and defining a hole;

a piston tube including a lower end connected with the piston and an upper end located beyond the cylinder;

a tube including a lower end communicated with the hollow base and an upper end inserted into the piston tube through the hole defined in the piston; and a release valve mounted on the upper end of the piston tube, with the release valve being in communication with the tube, the hollow base and the article to be inflated to release excessive pressure from the tube, the hollow base, and the article to be inflated.

2. The pump according to claim 1 including a pressure gauge mounted on and communicated with the hollow base.

3. The pump according to claim 1 including a pipe communicated with the hollow base and a nozzle communicated with the pipe for engagement with a valve of the article to be inflated.

4. The pump according to claim 1 wherein the hollow base includes two treads formed thereon.

5. The pump according to claim 1 including a handle mounted on the upper end of the piston tube.

6. The pump according to claim 1 including a plug being fit in the lower end of the cylinder and including a first channel in which the check valve is fit and a second channel in which the lower end of the tube is inserted.

* * * * *